United States Patent [19]

Goossens

[11] Patent Number: 4,923,118

[45] Date of Patent: May 8, 1990

[54] ANTI-VIBRATION SUPPORT SYSTEM FOR RAILROADS

[76] Inventor: Armand Goossens, Beukenlaan 35, 1990 Hoeilaart, Belgium

[21] Appl. No.: 313,289

[22] Filed: Feb. 21, 1989

[51] Int. Cl.[5] ..... E01B 9/38

[52] U.S. Cl. ..... 238/283; 238/265; 238/310

[58] Field of Search ..... 238/283, 25, 280, 265, 238/281, 287, 297, 310, 312, 315, 338, 343

[56] References Cited

U.S. PATENT DOCUMENTS

| | | | |
|---|---|---|---|
| 2,719,676 | 10/1955 | Prater | 238/283 X |
| 3,300,140 | 1/1967 | Moses et al. | 238/25 |
| 3,351,283 | 11/1967 | Paasche et al. | 238/283 |
| 3,417,922 | 12/1968 | Vaulry | 238/283 X |
| 3,616,999 | 11/1971 | Ruble | 238/283 X |
| 3,784,097 | 1/1974 | Landis | 238/283 X |
| 3,904,112 | 9/1975 | Thim et al. | 238/265 X |
| 3,907,200 | 9/1975 | Bernard | 238/283 X |
| 4,106,694 | 8/1978 | Salvino | 238/283 X |
| 4,216,904 | 8/1980 | Vivion | 238/283 X |
| 4,454,985 | 6/1984 | Carter | 238/283 X |
| 4,616,395 | 10/1986 | Faresa et al. | 238/283 X |
| 4,648,554 | 3/1987 | McQueen | 238/283 |

*Primary Examiner*—Douglas C. Butler
*Attorney, Agent, or Firm*—Curtis, Morris, Safford

[57] ABSTRACT

The sole of each rail of a railroad track rests at regular intervals on a cushion of shock-absorbing material, the stiffness of each shock-absorbing cushion being such that the cushions form alternate resilient and rapid supports. Each cushion is placed in a shaped housing in a concrete sole plate and the rail is fastened on the sole plate. The concrete sole plates of the rail can be fastened into the ground, possibly with the interpositioning of an anti-vibration sole plate, or can be fastened on a concrete slab which is laid over anti-vibration supports.

4 Claims, 4 Drawing Sheets

ANTI-VIBRATION SUPPORT SYSTEM FOR RAILROADS

The present invention concerns a fastening system for the rails of a track which assures the vibration and acoustic insulation of the railroad tracks.

The wheels of the vehicles rolling on the rails create vibrations within them which produce deformations and wearing of the rails. Moreover, the vibrations of the track are transmitted to the vehicles and reduce their life span.

Finally, the vibrations of the rails are transmitted directly into the environment. In particular, subway trains constitute the major source of vibrations which are harmful to the urban environment. For most of the subway trains in use, dynamic analyses indicate rigid modes, flexural modes and torsional modes of the first order below 15 Hz. The vibrations which are created within the rails are absorbed with a time constant of more than one millisecond and, in fact, it generally approaches two milliseconds. This time constant is greater than the time interval between two successive dynamic stresses applied by the wheels of a vehicle (time interval related to the distance between the axles of the wheels), and it results in resonances between the vibrations of the rail and the vibrations of the vehicle itself. These resonances constitute a danger for the stability of the vehicles and a constraint on the comfort of the traveler.

The problem of anti-vibration insulation for the rails of railroad tracks, in particular, subway tracks, poses the problem of the optimal dimensioning of an anti-vibration insulation device since it is important to not create superimpositions of the vibration frequencies of the vehicle and a resonance frequency of the device for anti-vibration insulation device itself.

The present invention solves this problem by means of an anti-vibration support system for railroad tracks which assures optimal absorption of the vibrations of the rails while avoiding any effects of superimposed resonance.

In accordance with a second aspect, the invention also has as its object an anti-vibration support system for railroad tracks which assures an effective protection against the transmitting of the vibrations of the rail into the environment.

In accordance with the invention, the anti-vibration support system is characterized by the fact that the sole of each rail rests at regular intervals on a cushion made of shock-absorbing material arranged within a shaped housing within a concrete sole plate, the rail being fastened on the sole plate. The stiffness of each shock-absorbing cushion is selected in such a way that the cushions form alternate resilient and rigid supports. The concrete sole plate of the rail can be fastened in the ground, possibly with the interpositioning of an anti-vibration sole plate, or can be fastened on a concrete slab laid on anti-vibration supports.

The rail support system in accordance with the invention is described hereinafter with reference to the attached drawings, in which.

Figure 4:
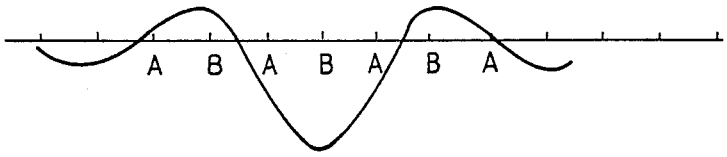
FIG. 4 is a diagram which illustrates the vibrational mode of a rail fastened on the anti-vibration supports in accordance with the invention.
Figure 4A:
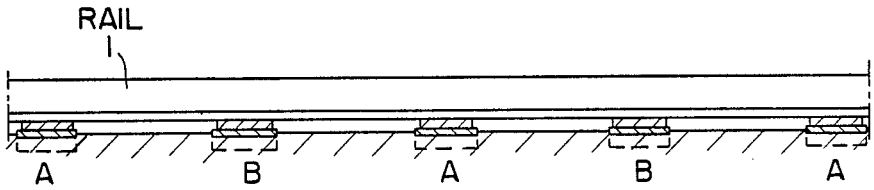

FIG. 4*a* illustrates the arrangement of neighboring anti-vibration supports in accordance with the invention.

Figure 5:
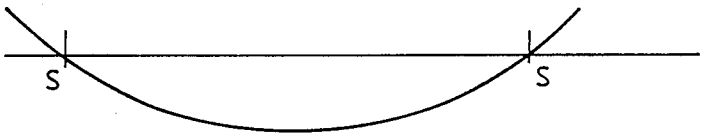
FIG. 5 PRIOR ART

FIG. 5 is a diagram which illustrates the vibration mode of a rail fastened in accordance with the known technique.

Figure 6A:
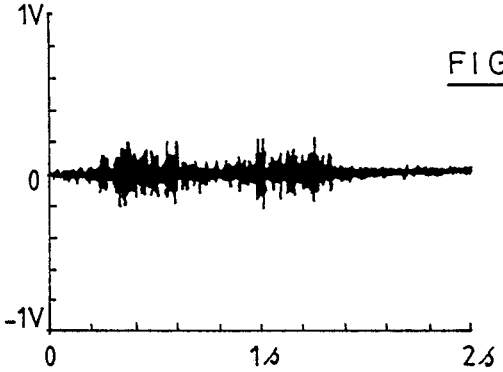
Figure 6B:
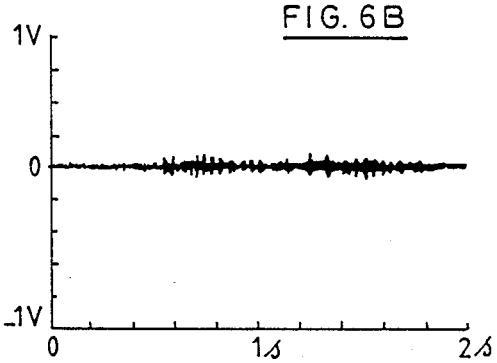

FIGS. 6A and 6B are two diagrams which show the vibration signals measured on a rail fastened on the anti-vibration supports in accordance with the invention, during the passing of a vehicle, the signal shown in FIG. 6A having been measured to the right of a resilient support and the signal shown in 6B having been measured to the right of a rigid support.

Figure 7A:
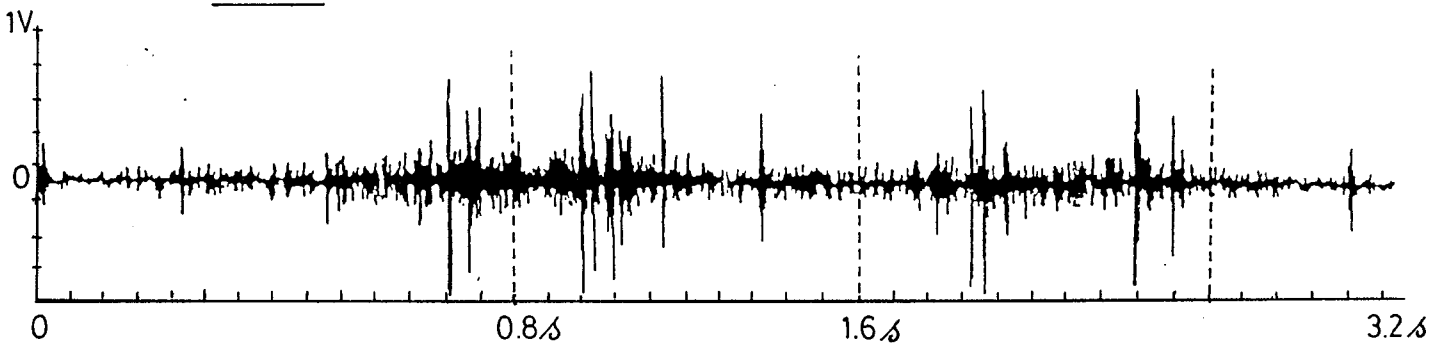
Figure 7B:
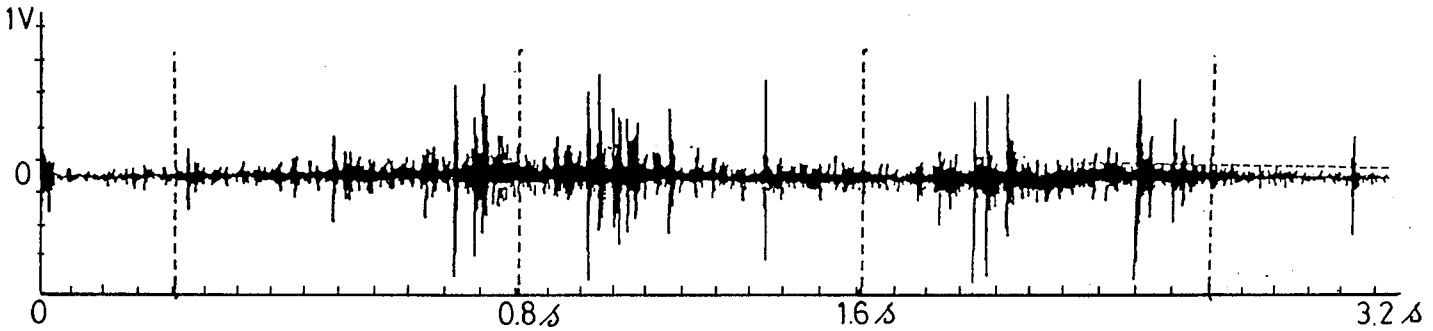

FIGS. 7A and 7B are two diagrams which show the vibration signals measured on a rail fastened to wooden ties, the signal shown in FIG. 7A having been measured to the right of a tie and the signal shown in FIG. 7B having been measured at 0.75 meters from said tie.

Figure 1:
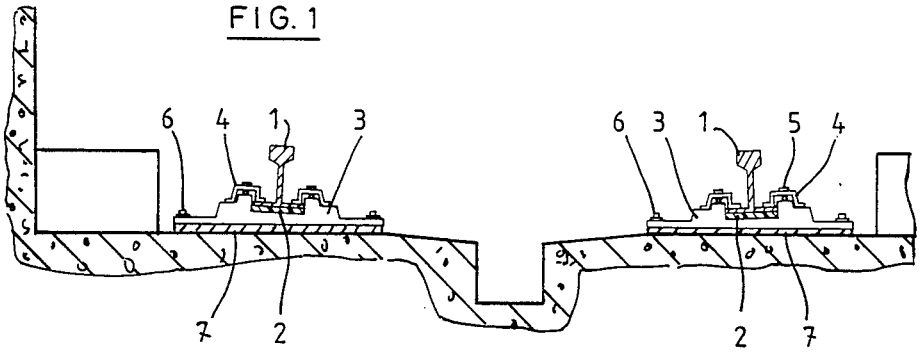
FIGS. 1, 2 and 3 illustrate diagrammatically three exemplary embodiments of the anti-vibration support system in accordance with the invention.
Figure 2:
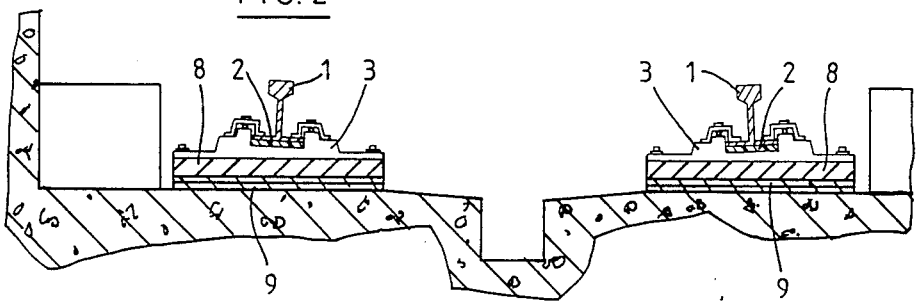
Figure 3:
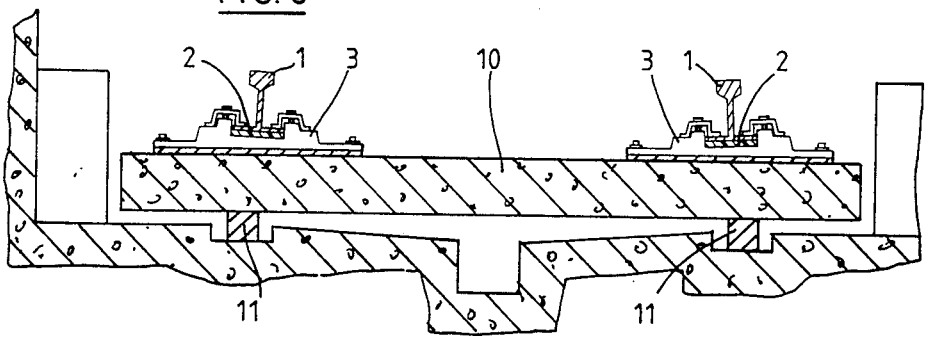

In FIGS. 1, 2 and 3, two rails 1 of a railroad track are shown, seen in the median plane of one of the supports on which each rail is fastened at regular intervals. On each support, the sole of the rail 1 rests on a cushion 2 of anti-vibration material placed within a shaped housing in a concrete slab or sole plate 3 and the rail is fastened on the sole plate 3 by means of clamps 4, the clamps themselves being fastened with bolts 5. In the embodiment illustrated in FIG. 1, the concrete sole plate 3 is fastened into the ground by means of bolts 6, with the interposition of a non-welding shim 7. The cushion of anti-vibration material 2 in each rail support is selected, in accordance with the invention, in such a manner that the rail rests alternately on a support having a high degree of shock absorbency and on a relatively rigid support. FIG. 4*a* illustrates the alternate arrangement of the relatively rigid and resilient supports in accordance with the invention for a rail 1. The relatively rigid supports are denoted A and the resilient supports are denoted B. FIG. 4*a* shows that along the rail 1, there are arranged successively a support A, a support B, a support A, a support B, and so on. Neighboring supports are always a substantially rigid one (support A) and a resilient one (support B). Each support A is a support which includes a shock-absorbing pad having a high dynamic stiffness; each support B is a support which includes a shock-absorbing pad having a low dynamic stiffness and high damping capability. The values of the rigidity and shock absorbency of the supports are determined as a function of the local conditions (maximal speed of rolling, type of rail, spacing between the supports, etc.). These values of rigidity and shock absorbency are obtained by the use of cushions 2, of extremely resistant composite materials the composition of which is adapted to requirements.

An optimization of the anti-vibration insulation is obtained by using anti-vibration cushions of 10 to 30 millimeters of thickness when the stiffness of the resilient supports varies between $2\times10^6$ Newton/m and $2\times10^7$ Newton/m and when the stiffness of the rigid supports varies between $2\times10^8$ Newton/m and $2\times10^9$ Newton/m. The spacing between the resilient support and the rigid support is, for example, 750 mm.

The dynamic characteristics of a rail fastened in accordance with the invention, and of a rail placed in customary manner on ballast, have been compared. In each case, the first resonant frequency and the associated mode of vibration were determined. FIG. 4 shows the vibrational mode of a fastened rail on anti-vibration supports in accordance with the invention. This vibrational mode shows some nodes between the rigid supports A and some deflections of maximum amplitude near the resilient supports B. The maximum amplitude is reached in the resilient support near the wheel of a vehicle. The zone of influence is about 1.50 meters. The first resonant frequency measured is 303 Hz with an absorbency rate of 8%. The limited zone of influence and the high absorbency rate avoids superimposition of vibrations upon the passing of the second wheel of the bogie at a speed less than 80 km/h.

It is interesting to compare the vibrational mode shown in FIG. 4 with the vibrational mode of a rail placed in customary manner on the wooden ties, illustrated in FIG. 5. This mode shows simple flexing of the rail with a distance between two nodes S of about 10 meters. The first resonant frequence measured is 105 Hz with an increased time constant of absorbency.

During the passing of a vehicle, vibrational deformations were observed which are similar to the vibrational modes indicated above. Measurements of the vibration levels generated in the rail during the passing of a bogie at a speed of 10 km/h gave the following results:

Rail fastened in accordance with the invention:

39 $m/s^2$ in the resilient support and 13 $m/s^2$ in the rigid support.

Rail on standard wood sleepers: 64 $m/s^2$

It can be noted that the vibration levels are from two to five times weaker in the rail fastened on the anti-vibration support in accordance with the invention, in comparison to the rail fastened on wooded ties (ballast).

FIGS. 6A and 6B show a vibration signal measured on a rail fastened on the anti-vibration supports in accordance with the invention, during the passage of a bogie. FIG. 6A shows the signal measured straight above the a resilient support and FIG. 6B shows the signal measured straight above the a rigid support. It can be noted that the vibration signal at the level of a rigid support is delayed in comparison with the vibration signal measured at the level of the neighboring resilient support. This delay corresponds to the time of the passage of the wheel from the resilient support to the rigid support. These vibrations generated are very localized, with a very weak transmission along the rail. Such a result cannot be obtained when the rails are fastened on supports which are all identical.

The vibration signals shown in FIGS. 6A and 6B can be compared to a vibration signal measured on a rail fastened on wooden ties according to the prior art (FIGS. 7A and 7B). FIG. 7A shows the signal measured at the level of a tie (measuring point T) and FIG. 7B shows the signal measured at 0.75 meters from the measuring point T. It can be noted that the vibrations are being transmitted the whole length of the rail in a very marked fashion, which produces the harmful resonance effects mentioned previously in reference to the earlier known technique.

When the acoustic protection is of primary importance, it is possible to employ the embodiment shown in FIG. 2. In this embodiment, the concrete sole plates 3 of the rail bearing the anti-vibration cushions 2 are fastened into the ground with the interposition of anti-vibration support plates 8 of a composite material similar to that constituting the anti-vibration cushions 2. Reference number 9 indicates inserts for the placing of them at the right level. With this embodiment there is advantageously obtained a reduction of the noises which radiate into the environment on the order of 25 dBA.

A development of the support system in accordance with the invention is illustrated in FIG. 3. In this embodiment, the concrete sole plates 3 of the rail which bear the anti-vibration cushions 2 are fastened on a slab of concrete 10 which is placed on shock-absorbing supports 11. This embodiment constitutes a compromise between the track stability and the anti-vibration insulation and appears to be an optimal solution for assuring simultaneously a reduction in efficient absorbance of the vibrations of the rail and an excellent reduction in the transmitting of vibrations into the environment. The reduction of the noises radiating into the environment amounts to more than 25 dBA also with this embodiment.

The invention thus constitutes a very inexpensive solution which assures an efficient absorbance of the vibrations generated in the rail due to a dynamic bending of the rail. Furthermore, this solution also reduces the wear of the rail as well as the contact noises between the wheels of the vehicle and the rail. This system also has the advantage of being adaptable to most of the existing fastening systems and can be easily combined with a primary anti-vibration system of insulation (floating slabs).

I claim:

1. A support system for each rail of rails for a railroad track and the like, said system comprising:

a plurality of sole plates fastened on a concrete slab at spaced apart locations along each rail, each of said sole plates having a shaped housing adapted to receive a shock-absorbing cushion, a plurality of cushions of shock-absorbing material adapted to be received by said shaped housing, each of said cushions within said shaped housing for each distinct sole plate for supporting a rail of said railroad track, fastening means for fastening each rail to each of the sole plates located along said rail, each of said shock-absorbing cushions supporting a rail adapted to display a dynamic stiffness such that said rail is supported alternately on a relatively rigid support and an adjacent resilient support whereby, during a passage of a bogie on the track, a vibration signal generated by a first wheel of the bogie at the level of a resilient support is decayed when a second wheel of the bogie passes the said adjacent resilient support, thereby localizing vibrations of each rail, with a very weak longitudinal transmission of vibrations along said rail.

2. A system as defined in claim 1, wherein each sole plate comprises a concrete slab with an interposed anti-vibration plate.

3. A system as defined in claim 1, wherein a concrete slab comprises a shock-absorbing rest support.

4. A system as defined in claims 1, 2 or 3, wherein a stiffness of a shock-absorbing cushion is between $2\times10^6$ Newton/m and $2\times10^7$ Newton/m in a resilient support and between $2\times10^8$ Newton/m and $2\times10^9$ Newton/m in a rigid support.

* * * * *